United States Patent [19]

Barron

[11] Patent Number: 4,987,408

[45] Date of Patent: Jan. 22, 1991

[54] WATER SENSOR SYSTEM

[76] Inventor: Robert C. Barron, 258 SE. 4th Ave., Pompano Beach, Fla. 33060

[21] Appl. No.: 351,455

[22] Filed: May 10, 1989

[51] Int. Cl.[5] ..... G08B 21/00

[52] U.S. Cl. ..... 340/604; 340/605; 340/618; 340/620; 307/118; 200/61.04

[58] Field of Search ..... 340/604, 605, 618, 620; 200/61.04; 307/118; 323/239, 245; 455/602; 250/551

[56] References Cited

U.S. PATENT DOCUMENTS

| | | | |
|---|---|---|---|
| 4,020,478 | 4/1977 | Hatfield | 340/604 |
| 4,418,712 | 12/1983 | Braley | 340/604 |
| 4,464,582 | 8/1984 | Aragaki | 340/604 |
| 4,787,212 | 11/1988 | Hessey | 340/604 |
| 4,789,853 | 12/1988 | Gentilvomo | 200/61.04 |
| 4,796,658 | 1/1989 | Caple | 340/620 |
| 4,805,662 | 2/1989 | Moody | 200/61.04 |

*Primary Examiner*—Joseph A. Orsino
*Assistant Examiner*—Kinfe-Michael Negash
*Attorney, Agent, or Firm*—Malin, Haley, McHale, DiMaggio & Crosby

[57] ABSTRACT

The disclosure relates to a water sensor unit wherein a plurality of water related appliances or equipment can be simultaneously monitored and in the event of sensing water with respect to any one of the several items being monitored appropriate action is taken such as shutting off the power to the unit and simultaneously shutting off the water supply to that particular unit. The sensor unit comprises a plurality of electronic circuits which include a "memory" permitting retention of a ground fault even through a power failure for up to 500 hours.

19 Claims, 3 Drawing Sheets

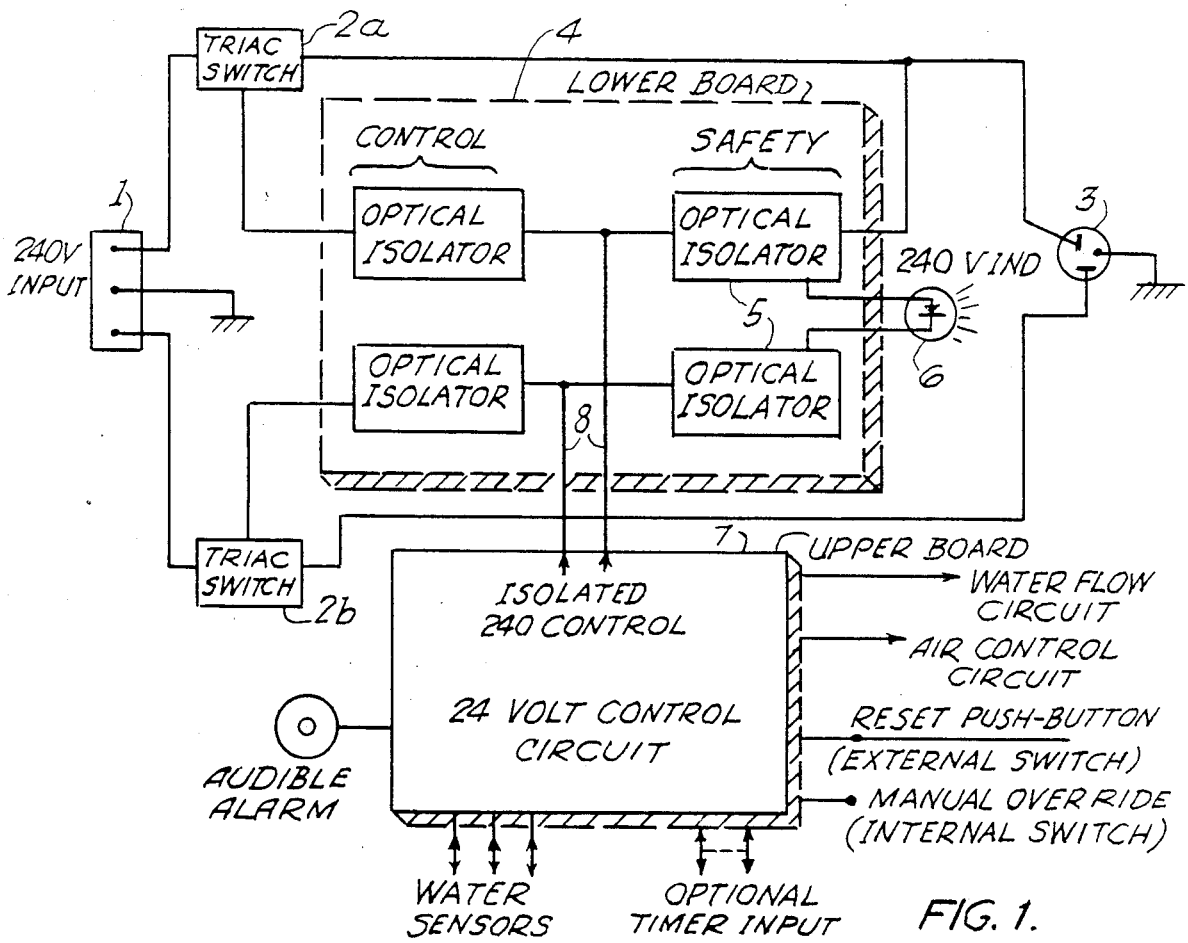
FIG. 1.
FIG. 4.
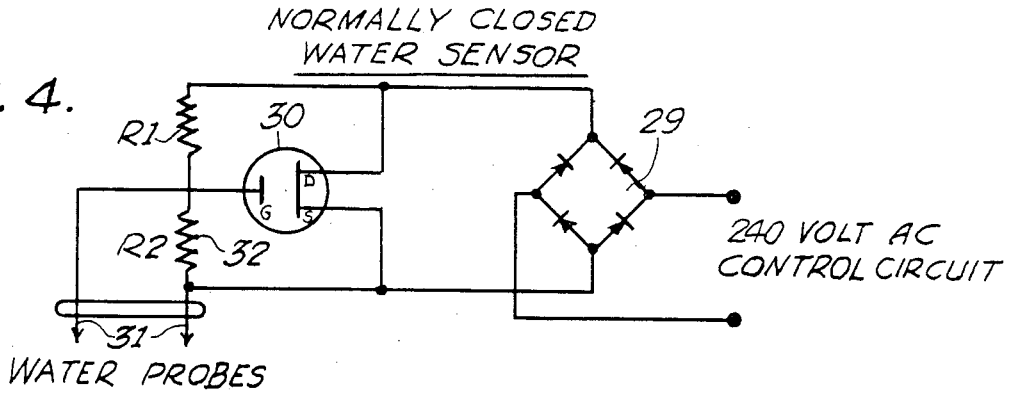
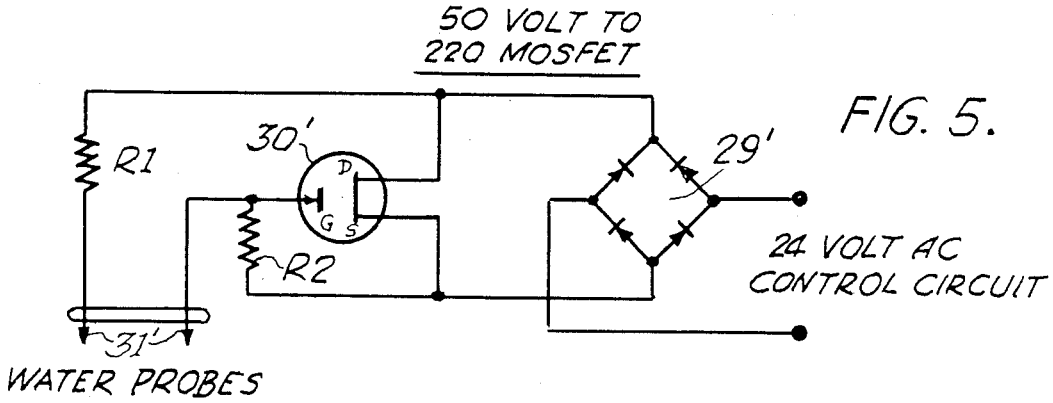
FIG. 5.

WATER SENSOR SYSTEM

BACKGROUND OF THE INVENTION

The invention relates to the detection of leakage water around household appliances. More specifically it relates to the detection of leakage water around appliances such as air conditioning units, a hot water heater or clothes washing machine.

Due to the absence of homeowners for a considerable amount of time each day and also the fact that most multi-story apartment buildings have many household units with each unit usually having at least three appliances which use or generate water and are subject to leakage for any one of a variety of reasons, there is a great need for water sensor systems which will monitor these various water related appliances.

There are known systems which utilize a water collecting tray under a water appliance such as a washing machine. An example of such a prior art device is disclosed in Thomas W. Collins U.S. Pat. No. 3,473,553, issued on Oct. 21, 1969. In the Collins patent, a float-actuated electrical switch closes an electrical circuit when sufficient water collects in a tray. A plunger is depressed to open a normally closed valve; and a latch pin is used to hold the valve in the open position. The pin is retracted by means of a solenoid, thus permitting the valve to be closed by a spring.

Devices such as the above described apparatus have not met with wide consumer acceptance. The main reason being due to the fact that there has to be a considerable amount of water leakage before the float will activate the switch. In some instances, the float has become inoperative due to the various deposits in the water which cause sticking of the linkage therefore resulting in flooding of the apartment, home or laundry room during the absence of the household occupants.

SUMMARY OF THE INVENTION

In view of the known inadequacies of prior art devices such as the one described above, Applicant has been motivated to develop a safety system which has eliminated these deficiencies.

Accordingly, applicant has designed a new and novel water sensor unit wherein a plurality of water related functions can be simultaneously monitored and in the event of sensing the presence of water with respective to any one of the several appliances being monitored, appropriate action is taken such as shutting off the power to the unit and simultaneously shutting off the water supply to that particular unit.

The safety unit plugs into a standard hot water heater outlet. The hot water heater in turn plugs into a receptacle on the safety unit. Power through the unit is controlled by two triacs, one on each side of the 240 Volt AC line. A pilot lamp indicates the presence of 240 volts at the receptacle. Control of one or two water solenoids is an available feature.

With respect to the safety features, the electronics of the unit are fused from the 240 volt line. An alarm will sound if the fuse blows. The use of two triacs assures that both sides of the 240 volt line are shut off. The triacs will not stay on unless both triacs are on. However, the pilot lamp will indicate power in the event that one triac has shorted out, i.e. if 120 volts to ground was present through such a failure. Additional safety features include the placement of all high voltage circuits on one board beneath a metal panel. All connections to this board to the control board are isolated through optical isolators (7500 volts isolation). Additional features of the water sensor unit will be discussed later in the specification.

OBJECTS OF THE INvENTION

An object of the invention is to provide a water sensor unit which utilizes electronic components which are not subject to the deficiencies of mechanical components.

A further object of the invention is to provide a water sensor unit which is quick to respond to the presence of water.

Yet another object of the invention is to provide a water sensor unit which can sense the presence of water around a plurality of water related appliances.

A still further object of the invention is to provide a water sensor unit which can control both the supply of water and power to a unit.

Another object of the invention is to provide a water sensor unit which includes both pilot indicator lamps and an audible alarm.

Yet another object of the invention is to provide a water sensor unit which will remember a fault and not lose "memory" of the fault even through a power failure for up to 500 hours.

These and other objects of the instant invention will become more apparent hereinafter. The instant invention will now be described with particular reference to the accompanying drawings which form a part of this specification wherein like reference characters designate the corresponding parts in the several views.

BRIEF DESCRIPTION OF THE DRAWINGS

FIG. 1 is a block diagram of the entire water sensor unit's control circuitry.

FIG. 4 is an illustration of the circuit for a normally "closed" water sensor.

FIG. 5 is an illustration of the circuit for an alternative normally "open" water sensor.

DETAILED DESCRIPTION OF THE DRAWINGS

Figure 2:
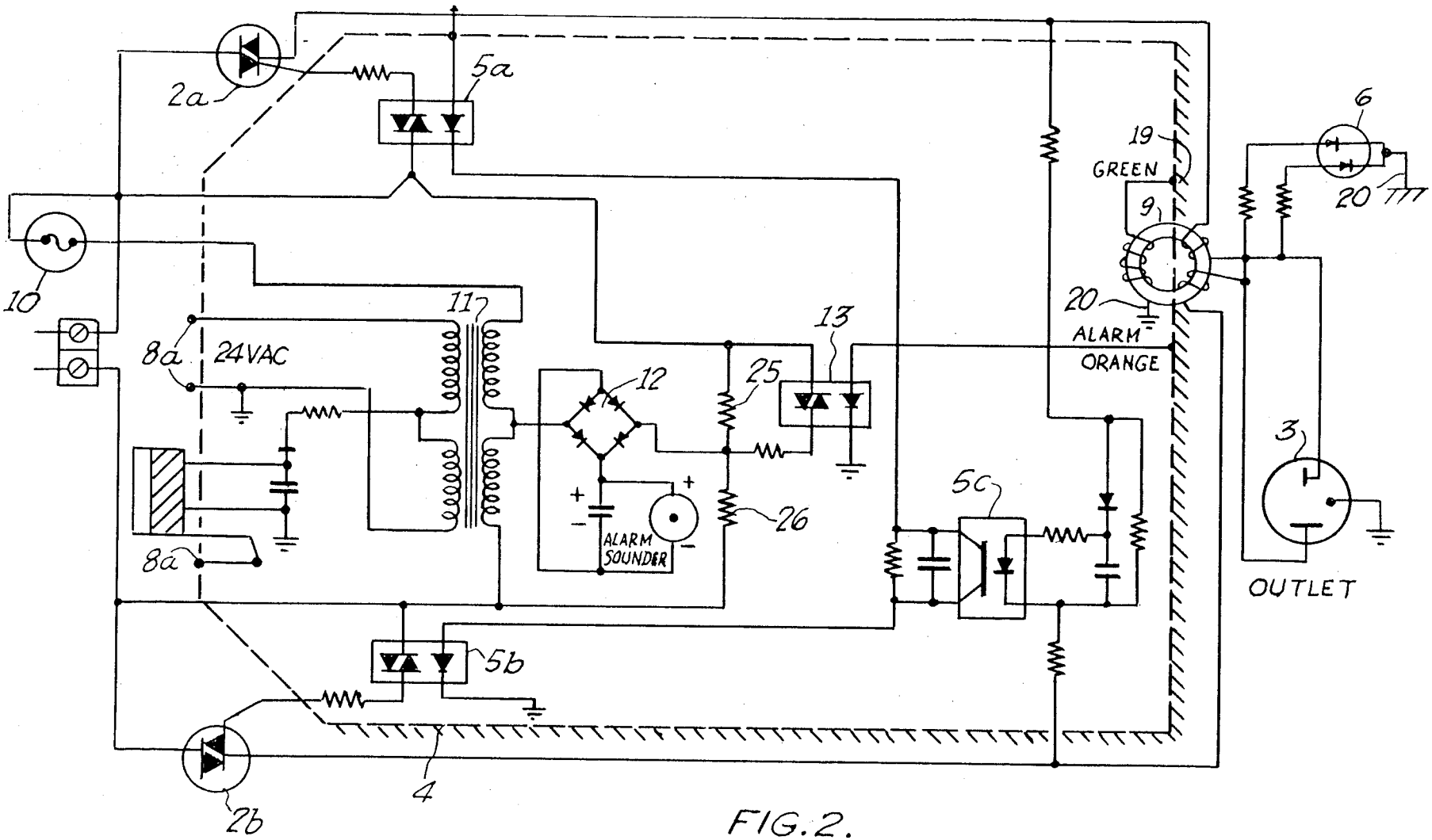
FIG. 2 is a diagram illustrating the electronic circuitry used in the lower board and chassis of the water sensor unit.

Referring now to FIG. 1, the major components of the water detector system are shown in the form of a block diagram. Input power for the system is provided by plug 1, which is connected to a 240 volt AC receptacle (not shown), usually the one provided for the electric water heater. Each side of the input line is connected to a triac 2*a*, 2*b*, and from the triacs to both the outlet receptacle 3 and to the lower board 4. This lower board includes optical isolator circuitry 5*a*, 5*b*, 5*c* and a pilot indicator lamp 6, as well as additional circuitry, all of which will be discussed in more detail below.

Isolated 24 volt ac and 5 vdc power is provided from the lower board 4 to the upper board 7 over lines 8*a* and 8*b*. The upper board performs all of the control functions of the system while operating at a safe voltage level for consumer protection. All of the water sensors and various control circuits for the water detector system, including and external alarm and optional timer, are connected to the low voltage upper board, and are completely isolated from the 240 volt supply.

In operation, the water detector system is connected to a 240 volt source through plug 1, and the electric hot water heater is connected to outlet 3. The triac switches 2a and 2b operate in conjunction with the optical isolators 5a5b, and 5c to control power to the hot water heater. If only one side of the 240 volt line is present, both triacs will be shut off. Other control functions, such as ground fault sensing, are discussed below.

The internal circuitry of the lower board is shown in detail in FIG. 2. The 240 volt input from plug 1 is connected through triac switches 2a and 2b and saturable torroid 9 to outlet 3, into which the electric hot water heater is plugged. The 240 volt input is also connected through fuse 10 to the primary side of transformer 11. The 240 volts is also connected across 47K resistors 25 and 26.

Normally bridge rectifier 12 has no ac input since the voltage at the center of the two 47K resistors is the same as that at the center tap of transformer 11. If the fuse blows or optical isolator 13 is activated by a fault signal from the upper board, then an unbalanced condition is created which presents ac voltage at bridge rectifier 12 to power the alarm sounder.

The 240 volt output is oontrolled from upper control board 7 through optical isolators 5a, 5b and 5c, with connections to the upper board at terminal 16 and 17.

A ground fault in the hot water heater connected to output 3 will be sensed in the saturable torroid 9, and auxiliary winding 18 will sense the fault condition and provide a signal to the upper board 7 through terminals 19 and 20.

Figure 3:
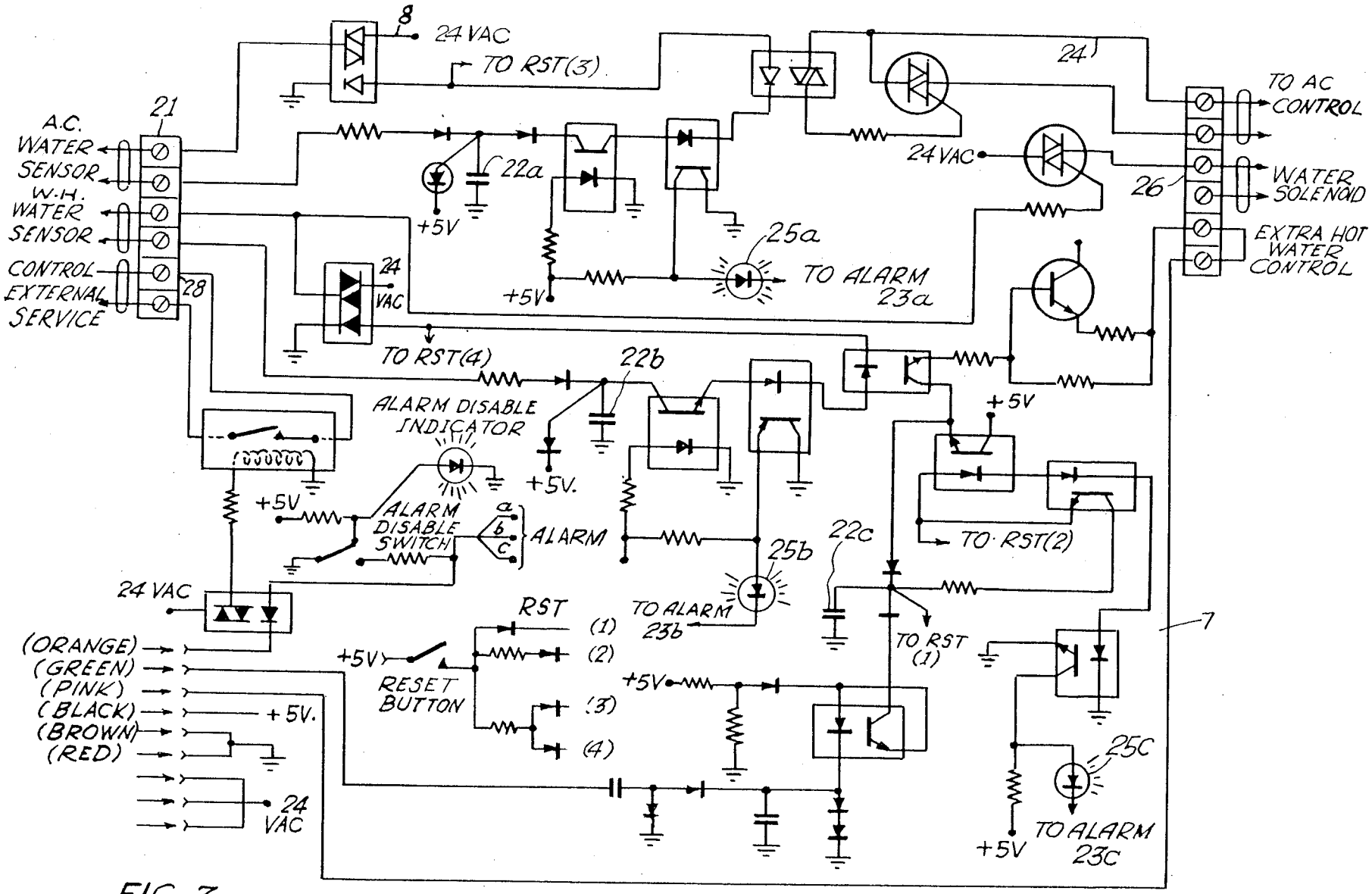
FIG. 3 is a diagram illustrating the electronic circuitry used in the upper control board.

Referring now to FIG. 3, the circuitry of the upper board 7 will now be discussed. The power for the control board is applied on lines 8 from the lower board 4. Water sensors are connected to terminal block 21 as indicated. These sensors are normally closed circuits, and are operated on alternating current to reduce connection deterioration. When water is sensed, the circuit opens, allowing storage capacitors 22a and 22b to discharge and disable the respective operation associated with the leak. For instance, if the air conditioner water sensor connected to terminal block 21 is tripped, capacitor 22a will discharge, triggering alarm input 23a, air conditioner control circuit 24 and air conditioner fault indicator lamp 25a. Once shut off, the controlled device cannot be turned on until the control circuit is manually reset. Storage capacitors 22a, 22b and 22c will "remember" a fault even during a power failure of up to 500 hours. These capacitors are completely isolated during a power loss.

Similar operation is provided from the water heater and miscellaneous water alarms. Water sensed will open the normally closed circuit, causing capacitor 22b to discharge, triggering alarm input 23b, water fault indicator lamp 255 and water solenoid controls 26.

A separate signal may also be provided over terminals 27 to the optional hot water heater control which will trip the triac switches 2a and 2b on the lower board 4 and disconnect power to the hot water heater.

The ground fault signal developed by the auxiliary winding 18 of saturable torroid 9 on lower board 4 is hard wired from terminal 19 on the lower board 4 to terminals 19' on the upper board 7. In the same manner as described for the water sensors above, a ground fault signal will cause capacitor 22c to discharge, triggering alarm input 23c, ground fault indicator lamp 25c and cause triac switches 2a and 2b to disconnect power to the hot water heater outlet 3.

The alarm inputs 23a, 23b and 23c may be used to trigger an external audible alarm as shown in FIG. 1. The alarm may be connected to terminal 28 as indicated in FIG. 3.

FIGS. 4 and 5 are examples of the types of water sensors which may connect to terminal block 21. FIG. 8 illustrates the preferred, normally closed circuit design with bridge rectifier 29, MOSFET 30, and water probes 31. Sensing of water by probes 31 will short the source and gate electrodes, effectively eliminating resistor 32 and triggering the detector system by turning off MOSFET 30.

In FIG. 5, sensing of water by probes 31' closes the drain-to-gate connection and triggers the detector system by turning on MOFSET 30'.

Thus it is apparent that activation of any of the water sensors connected to terminal block 21 will cause discharging of the appropriate storage capacitor, activation of the audible alarm, lighting of the appropriate indicator lamp and initiation of the appropriate control circuitry, whether it is to shut off the air conditioner, shut off the water supply or terminate power to the hot water heater. Likewise, sensing of a ground fault condition in the hot water heater will discharge a storage capacitor, trigger an alarm, indicator lamp and disconnect power to the heater outlet.

While the invention has been described in its preferred embodiment, it is to be understood that the words which have been used are words of description rather than limitation and that changes may be made within the purview of the appended claims without departing from the full scope or spirit of the invention.

Having thus described my invention, I claim:

1. A water detector system for the detection of standing water indicative of an abnormal condition in a building or other habitable structure, said system comprising:

a power circuit comprising at least two electrically conducting leads, each of said leads electrically connected at one end to an input which is electrically connected to a source of alternating current, each of said leads electrically connected at their respective other ends to an output which is electrically connected to an electrical appliance which is to be protected, said electrical appliance receiving its electrical power through said leads of said power circuit;

means, electrically connected intermediate said power circuit input and output and connected to each lead of said power circuit, for providing control of said power circuit, said means for providing control including isolating means for protecting personnel from the hazards of electrical shock from contact with said source of alternating current;

means, connected to said means for providing control, for initiating alarm signals and control signals responsive to the detection of standing water, said control signals triggering said means for providing control of said power circuit to disconnect said protected electrical appliance from said source of alternating current; and, a plurality of water sensors connected to said means for initiating alarm signals and control signals, said water sensors capable of detecting standing water.

2. A water detector system as claimed in claim 1, in which said means for providing control of said power circuit includes triac means electrically connected to said leads between said input and said output for control of current from said input to said output whereby said control signals generated in response to the detection of standing water cause said triac means to prevent electrical current from flowing along said leads.

3. A water detector system as claimed in claim 2, which includes means for sensing a ground fault in said power circuit or said electrical appliance and initiating a control signal which causes said triac means to electrically disconnect said appliance from said source of alternating current.

4. A water detector system as claimed in claim 1, in which said isolating means for protecting personnel include light emitting diodes and associated phototransistors placed between said power circuit and said means for providing control of said power circuit whereby personnel are electrically isolated from the electrical current present in said power circuit.

5. A water detector system as claimed in claim 1, in which said water sensors include means for converting alternating current, provided from said isolating means for protecting personnel, to direct current, means for creating a continuous electrical current path only in the presence of standing water whereby said standing water becomes an integral, electrically conducting element of said continuous electrical current path, said standing water thereby electrically completing said continuous current path; and, means for communicating the presence of said continuous electrical current path to said means for initiating alarm signals and control signals, thereby indicating the presence of water.

6. A water detector system as claimed in claim 5, in which said means for providing a continuous electrical current path includes two spaced apart water probes; wherein said means for converting alternating current to direct current includes a full wave diode rectifier positioned across the drain and source of a field effect transistor, said full wave diode rectifier electrically connected to said isolating means for protecting personnel; and, wherein said means for providing a continuous electrical current path also includes two resistors operating as a voltage divider biasing the gate of said field effect transistor causing said field effect transistor to conduct electrical current from said drain to said source in the absence of water between said water probes, each of said water probes respectively electrically connected to each side of said resistor positioned between said gate and said source of said field effect transistor so that an electrical circuit containing said water probes is in parallel with said resistor positioned between said gate and said source, whereby the presence of water between said water probes dissipates the bias of said gate of said field effect transistor, thereby shutting off said field transistor, whereby in the presence of water between said water probes, the only electrical current flowing through said water sensor flows through said resistor positioned between said drain and said gate and through said water probes and the water therebetween, which electrical current flows in a reduced amount in comparison to the electrical current flowing through said water sensor in the absence of water between said water probes.

7. A water detector system as claimed in claim 5, in which said means for providing a continuous electrical current path includes two spaced apart water probes; wherein said means for converting alternating current to direct current includes a full wave diode rectifier positioned across the drain and source of a field effect transistor, said full wave diode rectifier electrically connected to said isolating means for protecting personnel; and, wherein said means for providing a continuous electrical current path also includes two resistors positioned so as to bias the gate of said field effect transistor between the drain and gate of said field effect transistor, to turn on said field effect transistor in the event of the presence of water between said water probes, said water probes electrically connected in series with said resistor positioned between said gate and said drain, said water probes and the water therebetween being integral electrically conducting elements of the circuit between said gate and said drain of said field effect transistor.

8. A water detector system as claimed in claim 5 wherein said means for communicating the presence of said continuous electrical current path to said means for initiating alarm signals and control signals includes means for detecting the reduction in electrical current flowing through said water sensors in response to water present between said water probes.

9. A water detector system for the detection of standing water indicative of an abnormal condition in a building or other habitable structure, said system comprising:

a power circuit comprising at least two electrically conducting leads, each of said leads electrically connected at one end to an input which is electrically connected to a source of alternating current, each of said leads electrically connected at their respective other ends to an output which is electrically connected to an electrical appliance to be protected, said electrical appliance receiving its electrical power through said leads of said power circuit, said power circuit having a triac switch means electrically connected in each of said leads whereby the flow of electrical current through said leads is controlled by the operation of said triac switch means;

means electrically connected to said triac switch means, including optical isolator control means, for controlling each of said triac switch means;

a low voltage power supply connected between said electrically conducting leads of said power circuit;

an alarm circuit, said alarm circuit including optical isolator means to electrically isolate said alarm circuit from said power circuit;

and, means powered by said low voltage power supply, including a plurality of water sensors and associated circuitry, for detecting standing water and generating a control signal at said sensor, whereby said control signal enables said alarm circuit and causes said triac switch means to discontinue the flow of electrical current through said leads, thereby protecting said electrical appliance from electrically related damage and alerting persons near said electrically protected device to the presence of the standing water condition.

10. A water detector system as claimed in claim 9, further comprising means for disconnecting the water supply to said electrical appliance in response to said control signal.

11. A water detector system as claimed in claim 9, which includes means for sensing a ground fault in said power circuit or said electrical appliance and initiating a control signal which causes said triac switch means to electrically disconnect said appliance from said source of alternating current.

12. A water detector system as claimed in claim 11, in which, once a ground fault has been sensed, and alarm and control action has been taken, normal operation of said water detector system may not be restored except by manual resetting of the control circuits involved.

13. A water detector and cutoff system for detecting the presence of moisture in the immediate vicinity of a water consuming appliance an cutting off the supply of power and water thereto, said system comprising:

a power circuit comprising at least two electrically conducting leads, each of said leads electrically connected at one end to an input which is electrically connected to a source of alternating current, each of said leads electrically connected at their respective other ends to an output which is electrically connected to an appliance to be protected, said appliance receiving its electrical power through said power circuit;

means, electrically connected intermediate said power circuit input and output and connected to each lead of said power circuit, for providing control of said power circuit;

means for providing control of a solenoid valve to control the supply of water to said appliance;

means, connected to said means for providing control of said power circuit, for initiating alarm signals and control signals responsive to the presence of moisture, said control signals triggering said means for providing control of said power circuit to disconnect said water consuming appliance from said source of alternating current;

means, connected to said means for providing control of a solenoid valve, for initiating alarm signals and control signals responsive to the presence of moisture to trigger said means for providing control of a solenoid valve to cut off the supply of water to said appliance; and a plurality of water sensors operatively connected to said means for initiating alarm signals and control signals, for detecting standing water.

14. A water detector and cutoff system as claimed in claim 13 wherein said means for providing control of said power circuit includes isolating means placed between said power circuit and said means for providing control of said power circuit for protection of personnel from said source of alternating current.

15. A water detector and cutoff system as claimed in claim 14 wherein said means for initiating alarm signals and control signals is connected to said means for providing control of said power circuit through electrically isolating means for protecting personnel.

16. A water detector and cutoff system as claimed in claim 13 wherein said alarm signal actuates an audible alarm.

17. A water detector and cutoff system as claimed in claim 13 wherein said alarm signal actuates an audible and visual alarm.

18. A water detector system as claimed in claims 1, 9, or 13 further comprising:

means for initiating alarm signals and control signals in response to a blown fuse.

19. A water detector system as claimed in claims 1, 9, or 13 further comprising:

means to "remember" the state of the system during a power failure and return the system to the pre-power failure state when power returns.

* * * * *